United States Patent [19]

Home

[11] Patent Number: 4,932,392

[45] Date of Patent: Jun. 12, 1990

[54] ADJUSTABLE GAS MIXING PIPE FOR A GAS-RANGE

[75] Inventor: William Home, Taipei, Taiwan

[73] Assignee: Grand Hall Enterprise Co., Ltd., Taipei, Taiwan

[21] Appl. No.: 417,916

[22] Filed: Oct. 6, 1989

[51] Int. Cl.[5] ..... F24B 3/00

[52] U.S. Cl. ..... 126/41 R; 126/39 E; 285/305; 285/321; 431/354

[58] Field of Search ..... 126/41 R, 38, 25 R, 126/39 R, 39 E, 39 B, 39 N, 39 K, 40 R, 25 A, 315, 318; 431/354, 355; 285/305, 321; 48/180.1; 138/103, 118, 109, 122, 121

[56] References Cited

U.S. PATENT DOCUMENTS

| | | | |
|---|---|---|---|
| 3,625,551 | 12/1971 | Branton | 285/305 |
| 4,433,861 | 2/1984 | Kreczik | 285/305 |
| 4,624,240 | 11/1986 | Hitch | 126/41 R |
| 4,640,260 | 2/1987 | Perez | 126/41 R |
| 4,679,544 | 7/1987 | Koziol | 126/41 R |
| 4,773,384 | 9/1988 | Koziol | 126/41 R |

*Primary Examiner*—James C. Yeung

*Attorney, Agent, or Firm*—Merchant, Gould, Smith, Edell, Welter & Schmidt

[57] ABSTRACT

An adjustable mixing pipe for a gas-range including a flexible outer pipe, a first inner pipe and a second inner pipe. The flexible outer pipe has a first end communicated to a burner and is fastened to a frame of the burner. The flexible outer pipe further has a straight portion at a second end thereof with a first slot formed on a periphery of the straight portion. The first inner pipe is retractably received within the second end of the outer pipe and is fastened in the outer pipe by means of a first fastening spring provided in the first slot. The first inner pipe is slidable lengthwise in the outer pipe when the first fastening spring is pressed to be loosened. A second slot is formed on a periphery of the first inner pipe at a second end thereof. The second inner pipe is retractably received within the second end of the first inner pipe and is fastened in the first inner pipe by means of a second fastening spring provided in the second slot. The second inner pipe is slidable lengthwise in the first inner pipe when the second fastening spring is pressed to be loosened.

1 Claim, 4 Drawing Sheets

ADJUSTABLE GAS MIXING PIPE FOR A GAS-RANGE

BACKGROUND OF THE INVENTION

The present invention relates to an adjustable gas mixing pipe for a gas-range, particularly to a mixing pipe whose two ends are respectively attached to a burner of a gas-range and an igniter.

Conventionally, as shown in FIG. 7, a mixing pipe 5 communicating a burner and an igniting knob of a gas-range has an opening 51 formed thereon for mixing the gas and the air when the gas passes therethrough in order to obtain an appropriate gas-air ratio. However, such a mixing pipe must be formed to a certain shape, for example L-shaped as shown in FIG. 7, to fit between the burner and the igniting knob. A joint 52 in the mixing pipe 5 is shaped to match the corresponding dimensions of the igniting knob. Since these dimensions are fixed, a gas-range having different dimensions must be equipped with a corresponding mixing pipe of like dimensions. Accordingly, the mixing pipes of different types of gas-ranges are not interchangeable. Therefore, changing the mixing pipe is unavoidable when the user changes the type of gas-range.

FIG. 8 shows another type of conventional gas mixing pipes for a gas-range. A rigid pipe 61, having the same length as the mixing pipe 6, is arranged inside the mixing pipe 6. Accordingly, the mixing pipe 6 is restrained by the inner rigid pipe 61.

SUMMARY OF THE INVENTION

It is an object of the present invention to provide a gas mixing pipe for a gas-range wherein the length and direction for connection are adjustable.

It is another object of the present invention to provide an adjustable gas mixing pipe for a gas-range to allow easy installation.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
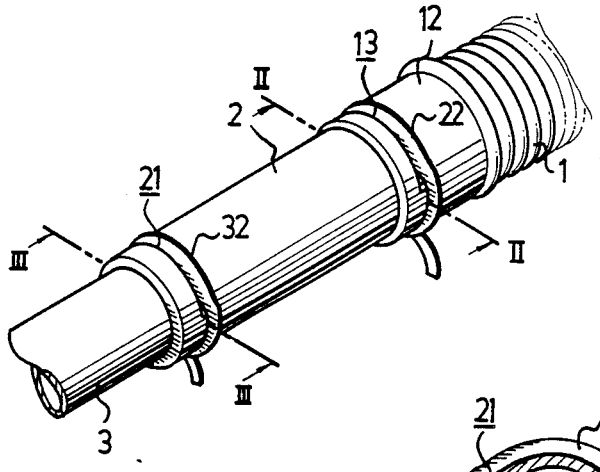
FIG. 1 is a partial perspective view of an adjustable gas mixing pipe for a gas-range in accordance with the present invention.
Figure 3:
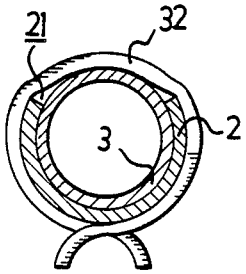
FIG. 3 is a cross-sectional view along the line III—III of FIG. 1.
Figure 2:
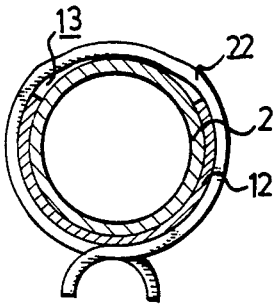
FIG. 2 is a cross-sectional view along the line II—II of FIG. 1.
Figure 4:
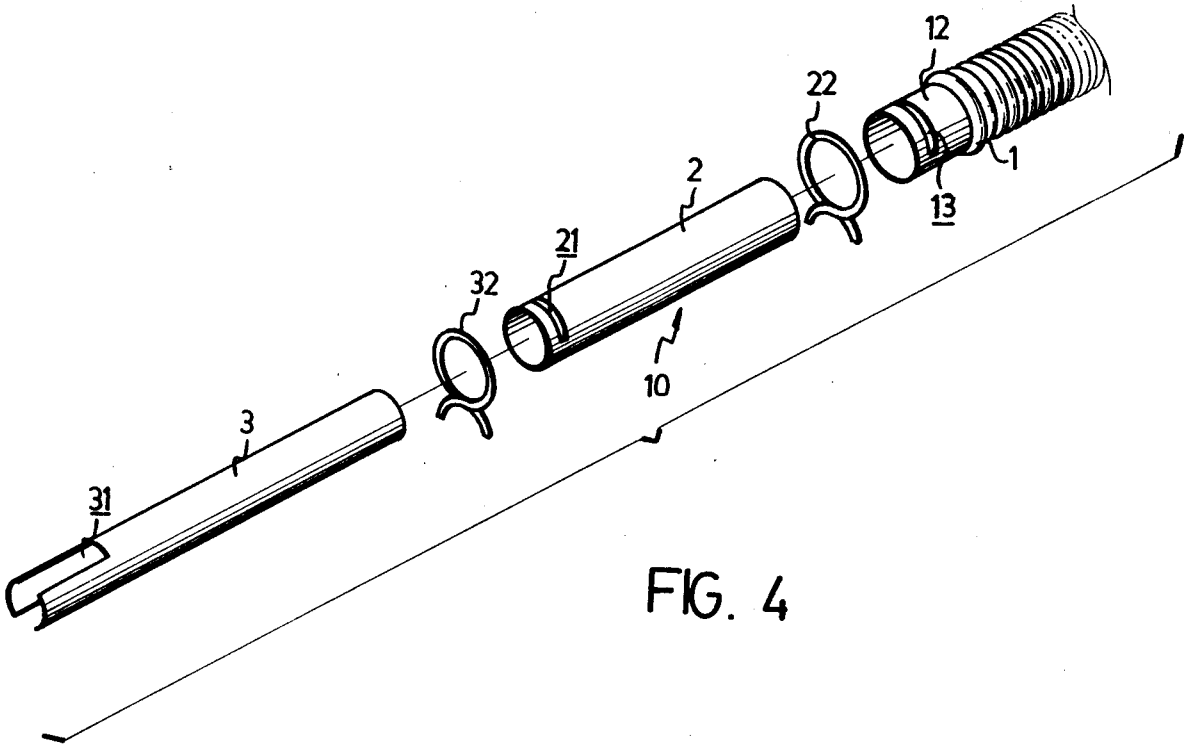
FIG. 4 is an exploded view of an adjustable gas mixing pipe for a gas-range according to the present invention.
Figure 5:
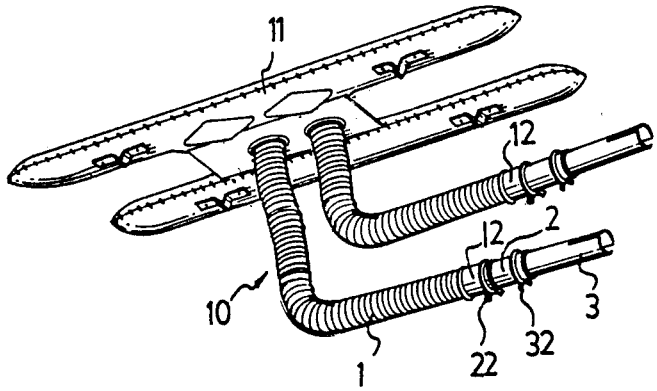
FIG. 5 is a perspective view of the gas mixing pipe, wherein two inner pipes are retracted into an outer pipe thereof.
Figure 6:
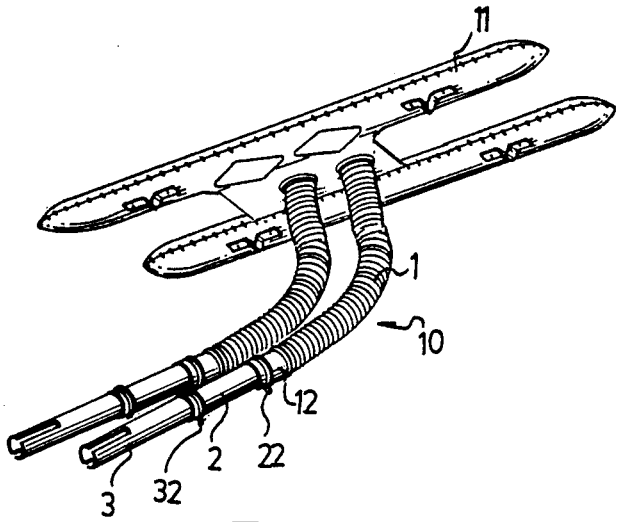
FIG. 6 is a perspective view of the gas mixing pipe, wherein the two inner pipes are extended from the outer pipe thereof.
Figure 7:
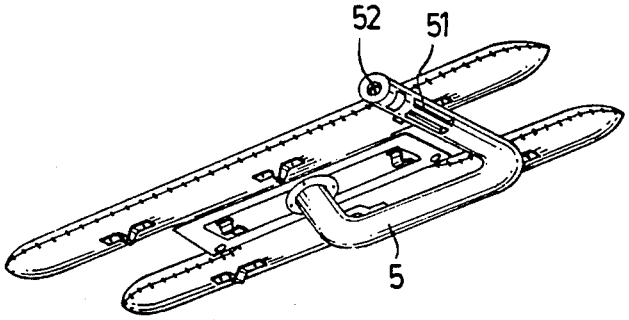
FIG. 7 PRIOR ART
FIG. 7 is a perspective view of a conventional gas mixing pipe.
Figure 8:
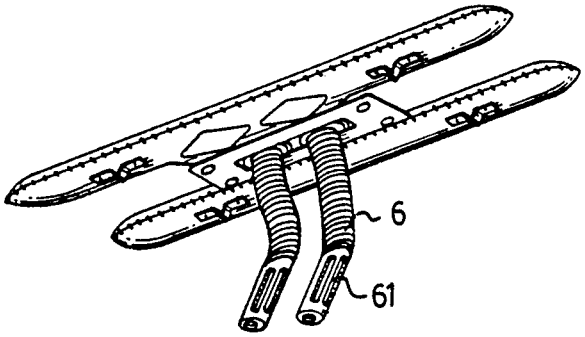
FIG. 8 PRIOR ART
FIG. 8 is a perspective view of another conventional gas mixing pipe.

Referring to FIGS. 1 to 6, an adjustable mixing pipe for a gas-range according to the present invention is shown. The adjustable mixing pipe 10 comprises a flexible outer pipe 1, a first inner pipe 2 and a second inner pipe 3. The flexible outer pipe 1 has a first end communicated to a burner (not shown) and is fastened to a frame 11 of the burner (as seen in FIGS. 5 and 6). The flexible outer pipe 1 further comprises a straight portion 12, with a first slot 13 formed on a periphery of the straight portion 12, at a second end thereof. The first inner pipe 2 is retractably received within the second end of the flexible outer pipe 1. The first inner pipe 2 is fastened in the flexible outer pipe 1 by means of a first fastening spring 22 provided in the first slot 13. The first inner pipe 2 is slidable along its length in the flexible outer pipe 1 when the first fastening spring 22 is pressed to be loosened. Conversely, the first inner pipe 2 is fixed when the first fastening spring 22 is in its unpressed state and contacts with an outer surface of the first inner pipe 2 and produces a binding effect as clearly shown in FIG. 2.

A second slot 21 is formed on a periphery of the first inner pipe 2 at a second end thereof. The second inner pipe 3 is retractably received within the second end of the first inner pipe 2 and is fastened in the first inner pipe 2 by means of a second fastening spring 32 provided in the second slot 21. The second inner pipe 3 is slidable along its length in the first inner pipe 2 when the second fastening spring 32 is pressed to be loosened.

Conversely, the first inner pipe 2 is fixed when the second fastening spring 32 is in its unpressed state and contacts with an outer surface of the second inner pipe 3 and produces a binding effect as clearly shown in FIG. 3. The second inner pipe 3 has an opening 31 formed on an exposed end thereof as shown in FIG. 4 which allows the gas to mix with air when the gas flows therethrough in order to obtain an appropriate gas-air ratio for combustion.

As shown in FIG. 5, both the two inner pipes 2 and 3 of the adjustable mixing pipe 10 are retracted into the flexible outer pipe 1. FIG. 6 shows the two inner pipes 2 and 3 of the adjustable mixing pipe 10 extended from the flexible outer pipe 1. Consequently, the adjustable mixing pipe 10, according to the present invention, can fit all types of gas-ranges. Furthermore, the flexible outer pipe 1 permits the present invention to be installed in any desired orientation.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. An adjustable mixing pipe for a gas-range comprising a flexible outer pipe, a first inner pipe and a second inner pipe, said flexible outer pipe having a first end communicated to a burner and being fastened to a frame of said burner, said flexible outer pipe further having a straight portion at a second end thereof with a first slot formed on a periphery of said straight portion, said first inner pipe being retractably received within said second end of said flexible outer pipe and being fastened in said flexible outer pipe by means of a first fastening spring provided in said first slot, said first inner pipe being slidable lengthwise in said flexible outer pipe when said first fastening spring is pressed to be loosened; a second slot being formed on a periphery of said first inner pipe at a second end thereof, said second inner pipe being retractably received within said second end of said first inner pipe and being fastened in said first inner pipe by means of a second fastening spring provided in said second slot, said second inner pipe being slidable lengthwise in said first inner pipe when said second fastening spring is pressed to be loosened, said second inner pipe having an opening formed on an exposed end for a gas mixing with outside air when the gas flows therethrough.

* * * * *